US006338650B1

(12) United States Patent
Dong

(10) Patent No.: US 6,338,650 B1
(45) Date of Patent: Jan. 15, 2002

(54) ROTATABLE CARD CONNECTOR

(75) Inventor: Shun Chi Dong, San Jose, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/627,353

(22) Filed: Jul. 28, 2000

(51) Int. Cl.[7] ..... H01R 13/73
(52) U.S. Cl. ..... 439/534
(58) Field of Search ..... 439/570, 569, 439/571, 572, 534

(56) References Cited

U.S. PATENT DOCUMENTS

| | | | | | |
|---|---|---|---|---|---|
| 5,795,187 | A | * | 8/1998 | Sipe | 439/534 |
| 5,934,936 | A | * | 5/2000 | Chiu et al. | 439/570 |
| 6,068,510 | A | * | 5/2000 | Tung | 439/567 |
| 6,071,135 | A | * | 6/2000 | Obara | 439/159 |
| 6,077,088 | A | * | 6/2000 | Yu et al. | 439/64 |

* cited by examiner

*Primary Examiner*—Gary F. Paumen
*Assistant Examiner*—James R. Harvey
(74) *Attorney, Agent, or Firm*—Wei Te Chung

(57) ABSTRACT

An electrical card connector includes an insulative housing 3, a plurality of terminals 5 received in the housing, and two fixing clips 7 attached to the housing. The insulative housing has a header 15 including a pivot 25, a plurality of passageways 21 for receiving the terminals therein, and two guiding bars 17 extending from two ends of the header each having a ledge 23 at a front end thereof. The pivot projects from each end of the header to provide a rotational axis for the fixing clip. The ledge includes a first positioning recess 45, a sliding face 47 and a second positioning recess 49. Each fixing clip has a base plate 29 fixed to a PCB, a joint section 33 extending from the base plate to prevent over-rotation of the housing, and an engaging section 35 for engaging with the insulative housing. The engaging section includes an engaging hole 37 for engaging with the pivot, a spring arm 39 extending from a free end thereof and having a protrusion 41 for engaging with the ledge, and a space 43 defined between the spring arm and the body of the engaging section. When the protrusion slides from the second positioning recess to the first positioning recess, the card connector is moved from an open position into a closed position.

1 Claim, 10 Drawing Sheets

ROTATABLE CARD CONNECTOR

BACKGROUND OF THE INVENTION

1. Field of the Invention

The present invention relates to a card connector, and particularly to a rotatable card connector for facilitating insertion of a card.

2. Description of the Prior Art

U.S. Pat. Nos. 6,068,510, 6,071,135 and 6,077,088 disclose some conventional card connectors. In these designs, the card connector is normally fixed at an edge of a printed circuit board (PCB) located in an electronic device. In assembly, a card is inserted through a cutout defined in the electronic device into the card connector along a direction parallel to the card connector. In other words, this design is only applicable in situations where the card connector occupies an edge of the PCB. However, in some special situations, the edge of the PCB is not available for mounting the card connector since the space on PCBs is becoming increasingly critical. Accordingly, the conventional mounting arrangement is no longer applicable in this situation. In other words, conventional card connectors cannot be used in situations where use of the board edge is denied. Hence, an improved card connector is required to overcome the disadvantages of the prior art. On the other hand, in some application situations of the notebook computer, the card is required to be inserted into the computer enclosure from the bottom plate instead of the side wall because of the internal compact arrangement of the notebook computer. Under this situation, a moveable card connector is desired which may either be exposed to an exterior from the bottom plate of the computer enclosure for insertion/withdrawal, or reliably and securely embedded within the computer enclosure when the card is inserted therein.

BRIEF SUMMARY OF THE INVENTION

A first object of the present invention is to provide a rotatable card connector which can be mounted at a side of a PCB of an electronic device;

A second object of the present invention is to provide a rotatable card connector for receiving an exterior card in an inclined direction.

Accordingly, a rotatable card connector in accordance with the present invention comprises an insulative housing, a plurality of terminals received in the housing, and two fixing clips attached to the housing. The insulative housing has a header including a pair of pivots at two ends thereof and a plurality of passageways for receiving the terminals therein, and two guiding bars extending from the two ends of the header each having a ledge at a front end thereof. The pivots project from each end of the header to provide a rotational axis for the fixing clip. The ledge includes a first positioning recess, a sliding face and a second positioning recess. Each fixing clip has a base plate for fixing to a PCB, a joint section extending from the base plate to prevent over-rotating of the housing, and an engaging section for engaging with the ledge of the insulative housing. The engaging section includes an engaging hole for engaging with the pivot, a spring arm extending from a free end thereof and having a protrusion for engaging with the ledge, and a space defined between the spring arm and the body of the engaging section.

When the card connector is retained in an open position where the protrusion of the spring arm is engaged with the second positioning recess of the ledge, an exterior card is inserted into the card connector in an inclined direction along the guiding bar. The housing is then rotated so that the protrusion moves along the ledge from the second positioning recess to the first positioning recess. When the card connector has moved to a closed position, the exterior card can be completely inserted into the card connector, and the protrusion of the spring arm is engaged with the first positioning recess.

Other objects, advantages and novel features of the invention will become more apparent from the following detailed description of the present embodiment when taken in conjunction with the accompanying drawings.

DETAILED DESCRIPTION OF THE INVENTION

Figure 1:
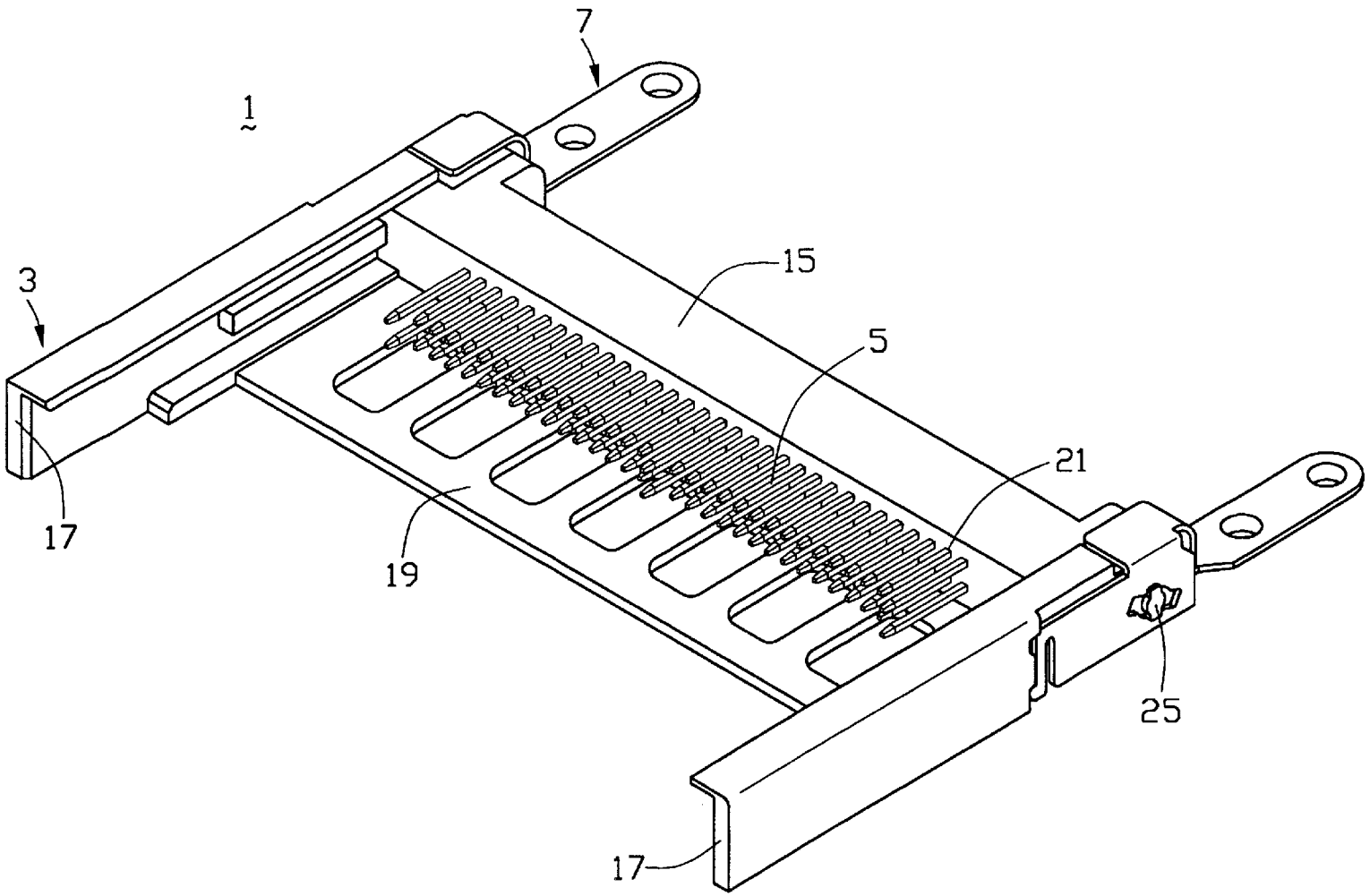
FIG. 1 is a perspective view of a rotatable card connector in accordance with the present invention in a closed position, the card connector having an insulative housing and a pair of fixing clips.
Figure 2:
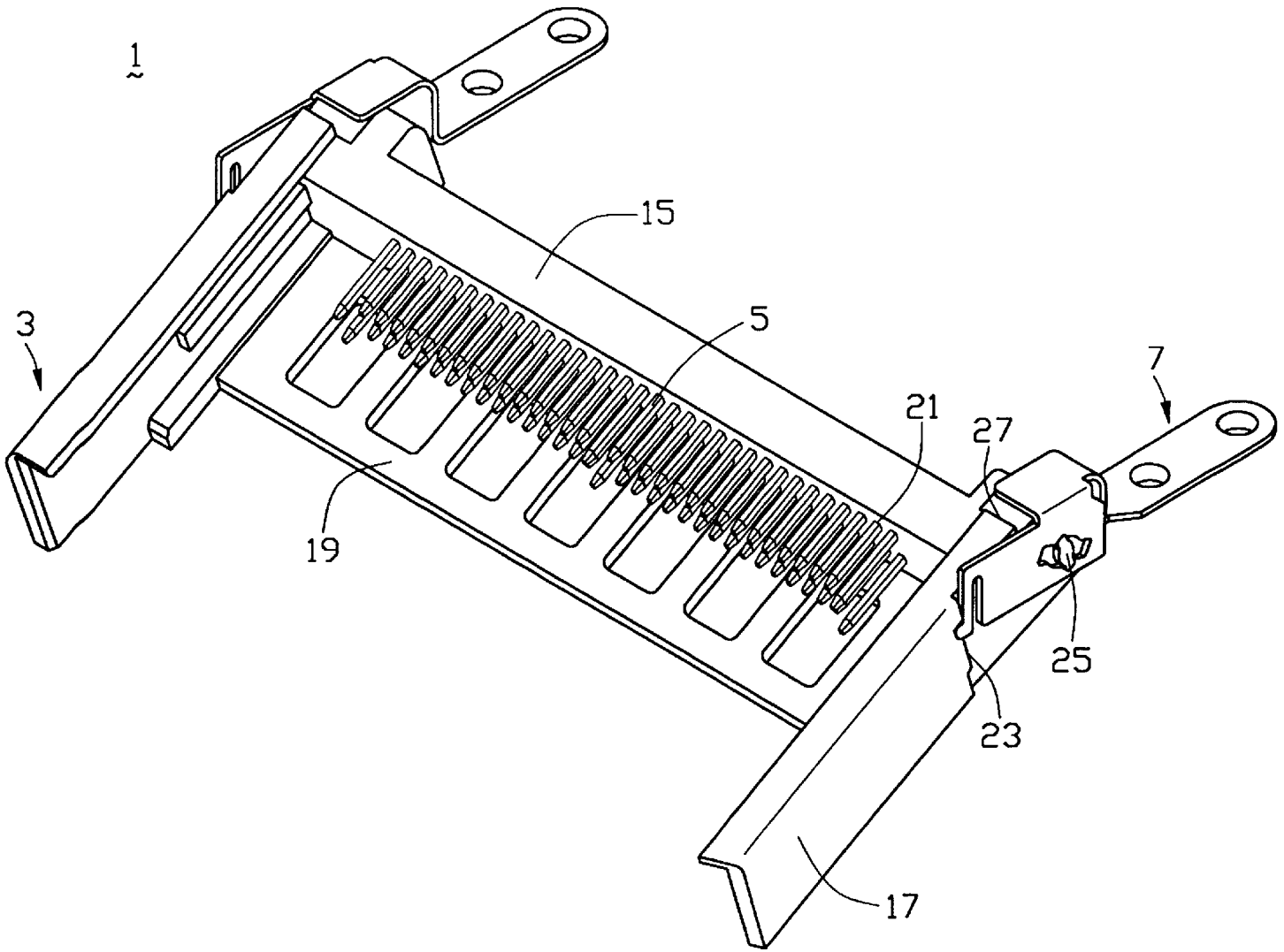
FIG. 2 is a perspective view of a rotatable card connector in accordance with the present invention in an open position.
Figure 3:
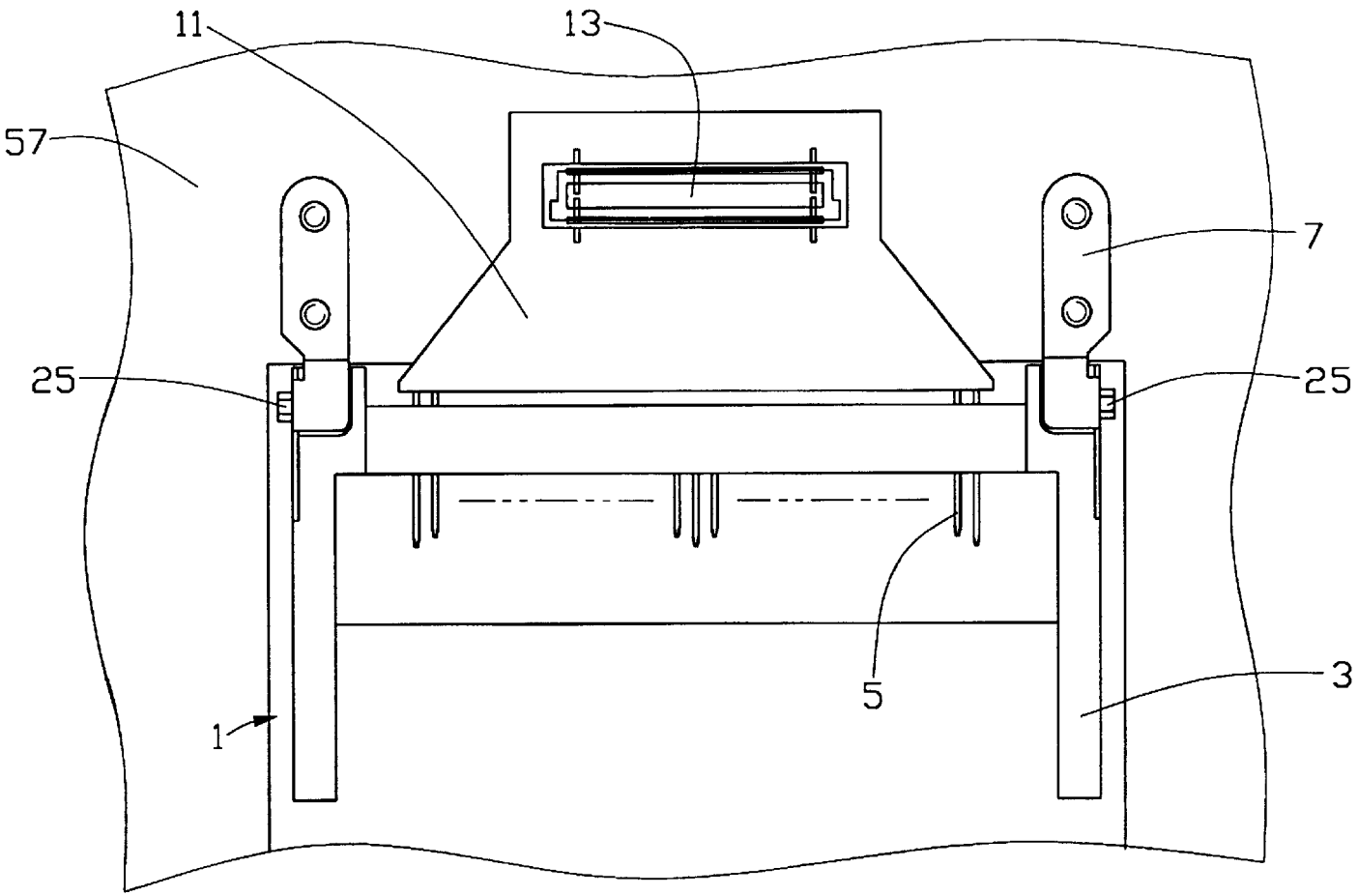
FIG. 3 is a top plan view of a rotatable card connector in accordance with the present invention connected with a printed circuit board via a flexible printed circuit board and a board-to-board connector assembly.
Figure 4:
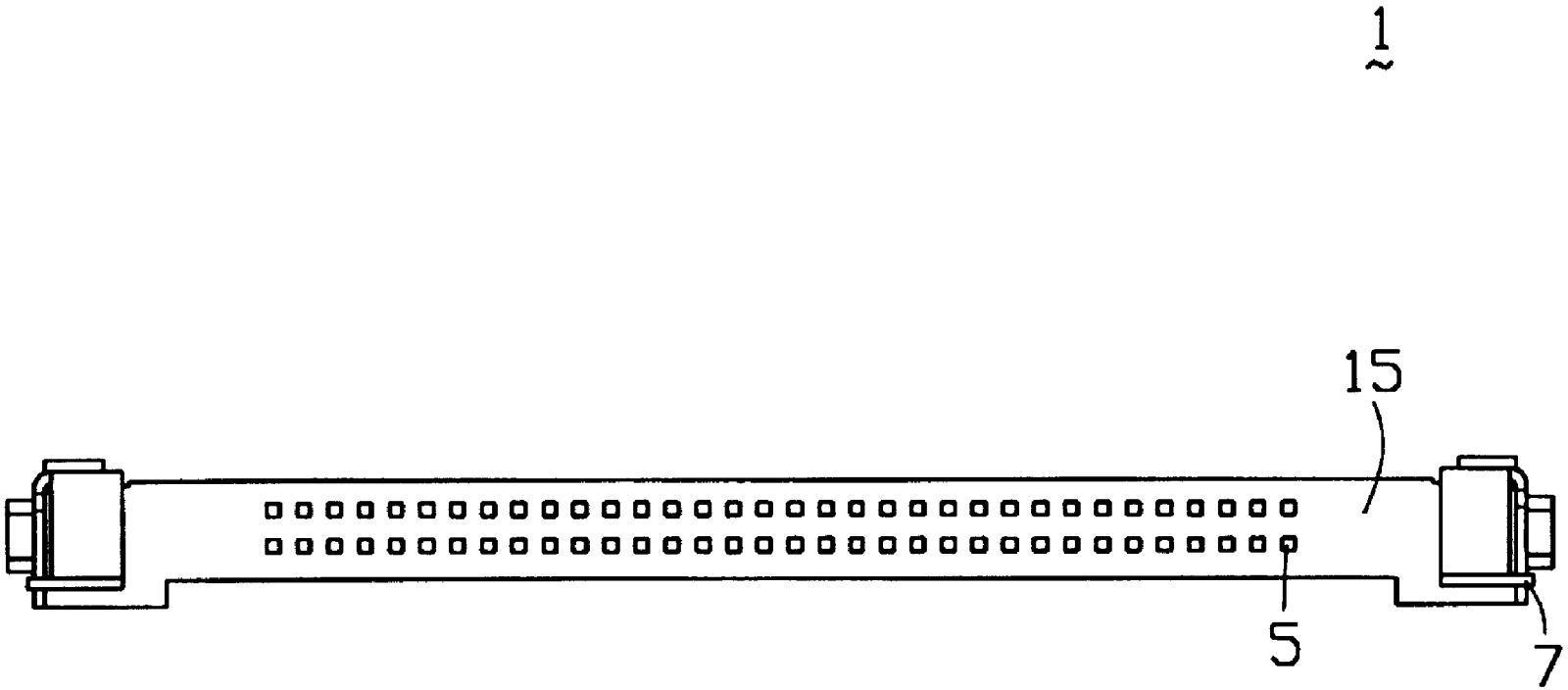
FIG. 4 is a front view of the rotatable card connector of FIG. 3.

Referring to FIGS. 1–4, a card connector 1 in accordance with the present invention comprises an insulative housing 3, a plurality of terminals 5 received in the insulative housing 3 and a pair of fixing clip 7 attached to the insulative housing 3. The card connector 1 connects with a printed circuit board (PCB) 57 via a flexible printed circuit board (FPC) 11 and a board-to-board connector assembly 13. The printed circuit board 57 defines an opening (not labeled) adapted for receiving the card connector 1 therein. The insulative housing 3 comprises a header 15, two guiding bars 17 respectively extending from opposite ends of the header 15 and a supporting plate 19. The header 15 defines a plurality of passageways 21 therethrough to receive the terminals 5. A ledge 23 is formed at a front end of each guiding bar 17 for engaging with the fixing clip 7. A pivot 25 projects from each end of the header 15 for engaging with the fixing clip 7. A stopper 27 is provided at a front end of each guiding bar 17 adjacent to each pivot 25 for abutting against the fixing clip 7.

Figure 5:
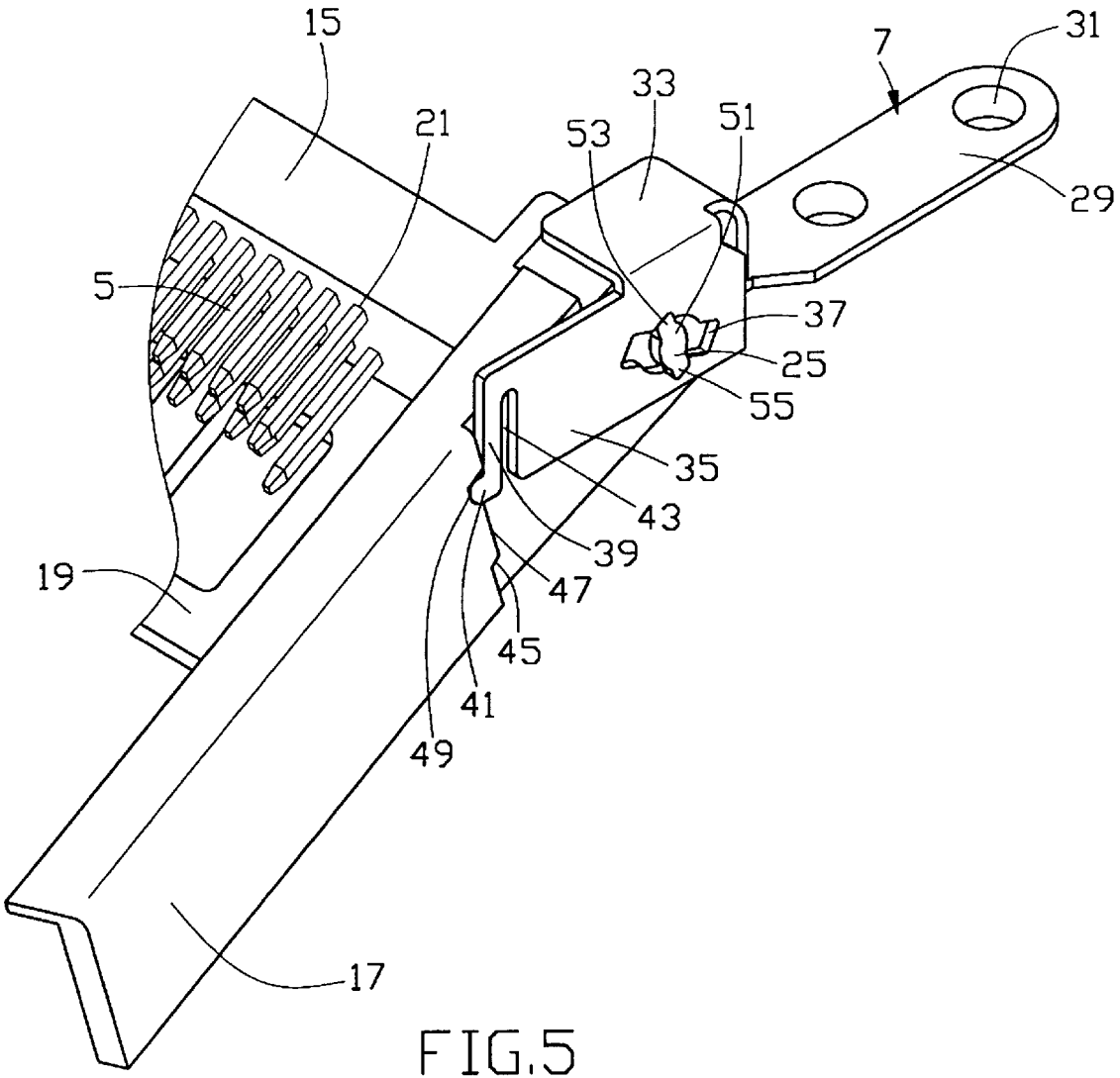
FIG. 5 is partial, enlarged view of FIG. 2.
Figure 6:
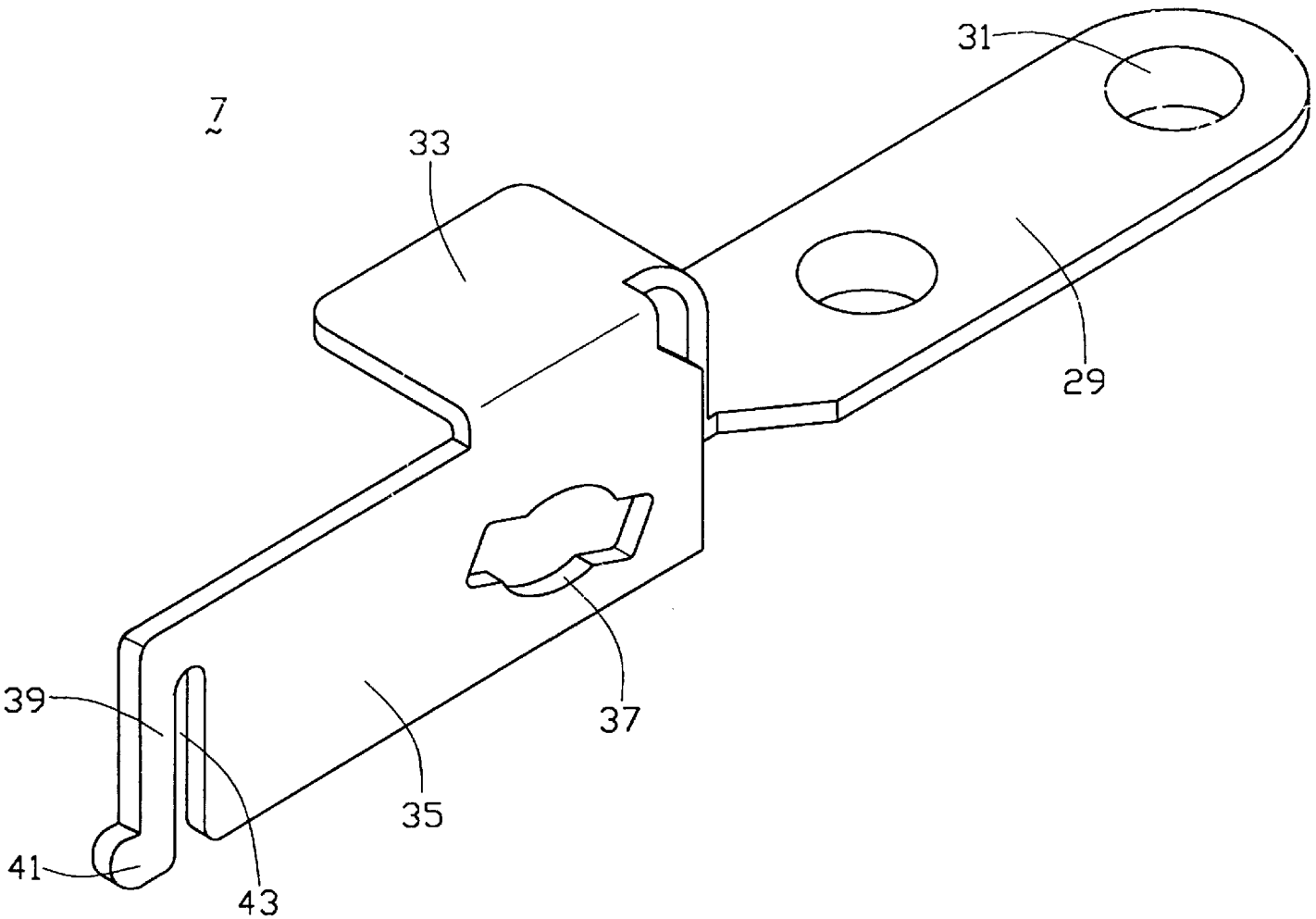
FIG. 6 is a perspective view of a fixing clip in accordance with the present invention.

Referring to FIGS. 5–6, the fixing clip 7 comprises a base plate 29 defining two holes 31, an L-shaped joint section 33 extending from the base plate 29 to prevent over-rotation of the housing 3, and an engaging section 35 extending from the joint section 33. The engaging section 35 further includes an engaging hole 37 having a shape similar to the pivot 25 for engaging with the pivot 25, and a spring arm 39 extending from one end thereof and having a protrusion 41 for engaging with the ledge 23. A space 43 is defined between the spring arm 39 and the main body of the engaging section 35 for providing resiliency to the spring arm 39.

The ledge 23 of the insulative housing 3 includes a first positioning recess 45, a sliding face 47 and a second positioning recess 49. Each pivot 25 includes a center post 51 and a pair of opposite rectangular projections 53 and 55 for engaging with the engaging hole 37 of the fixing clip 7.

Figure 7:
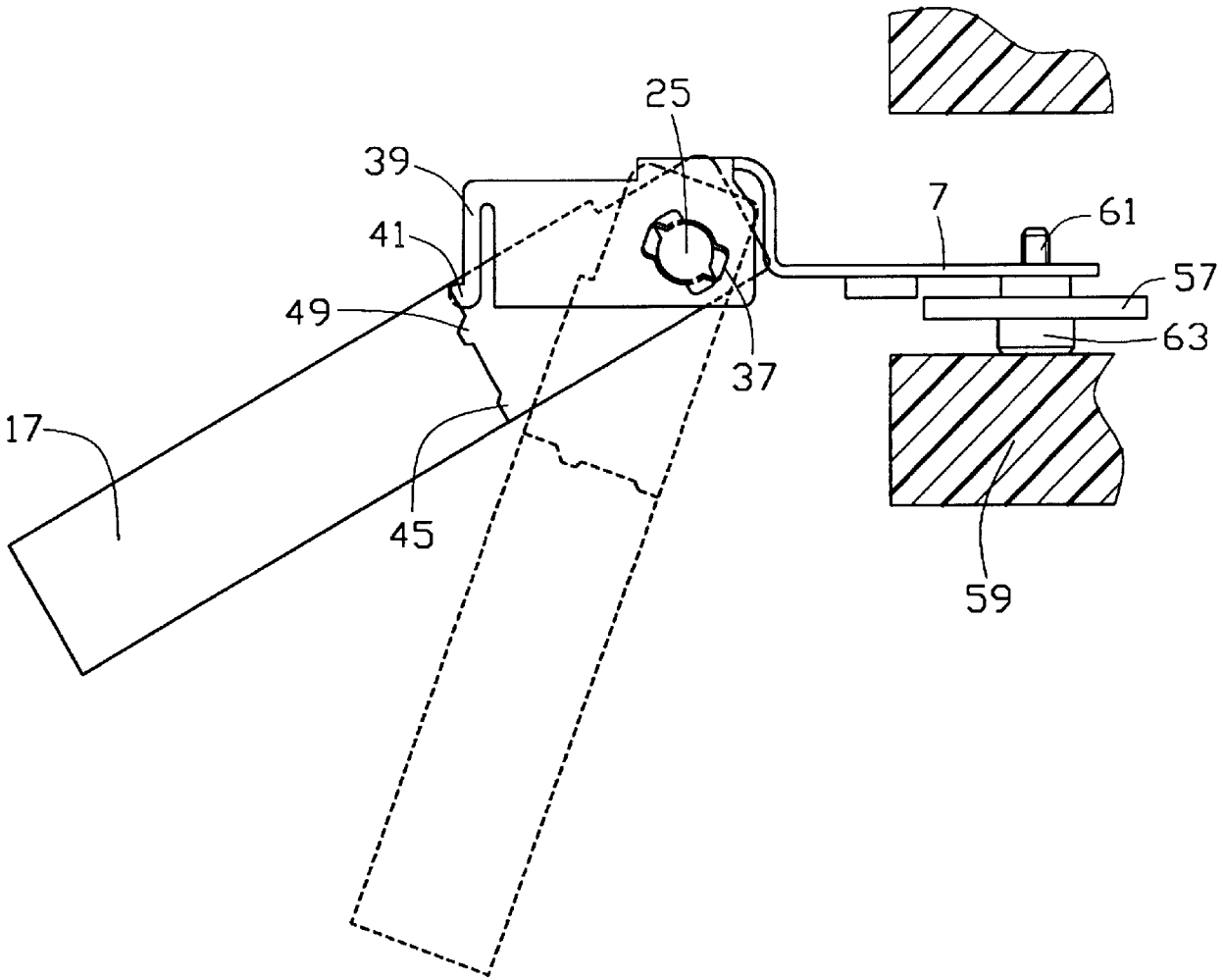
FIG. 7 is a side view illustrating the assembly process of the card connector.

Referring to FIG. 7, in assembly, the fixing clips 7 are first fixed to the PCB 57 and are secured to a base 59 of an electronic device (not shown) via a set of screws 61 extending through the holes 31 and a pair of nuts 63. The pivots 25 of the housing 3 are then fit into the engaging holes 37 of the fixing clips 7 and the housing 3 is rotated clockwise to an engaged position where the protrusion 41 of the spring arm 39 is located in the second positioning recess 49 and where the rectangular projections 53 and 55 abut against an outer surface of the engaging section 35 of the fixing clip 7.

Figure 8A:
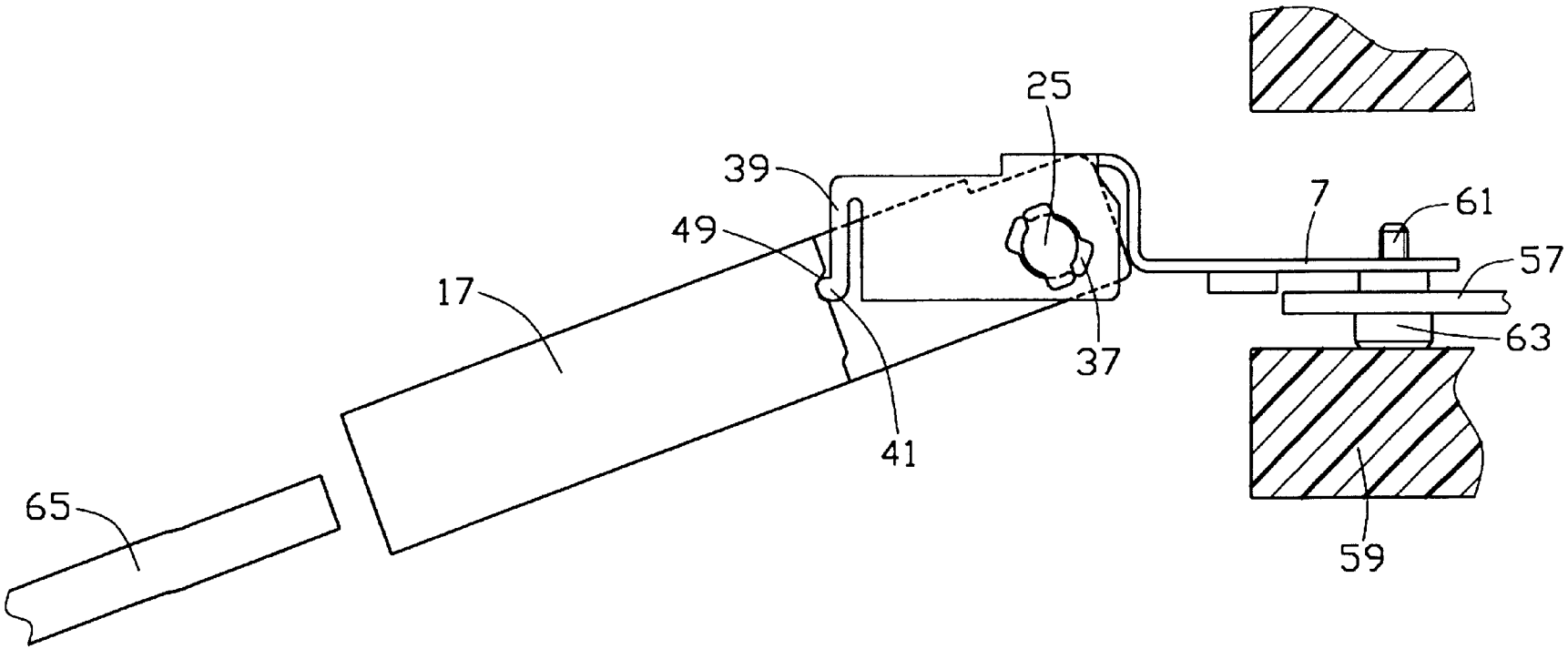
FIG. 8A is a side view of the card connector in an open position.
Figure 8B:
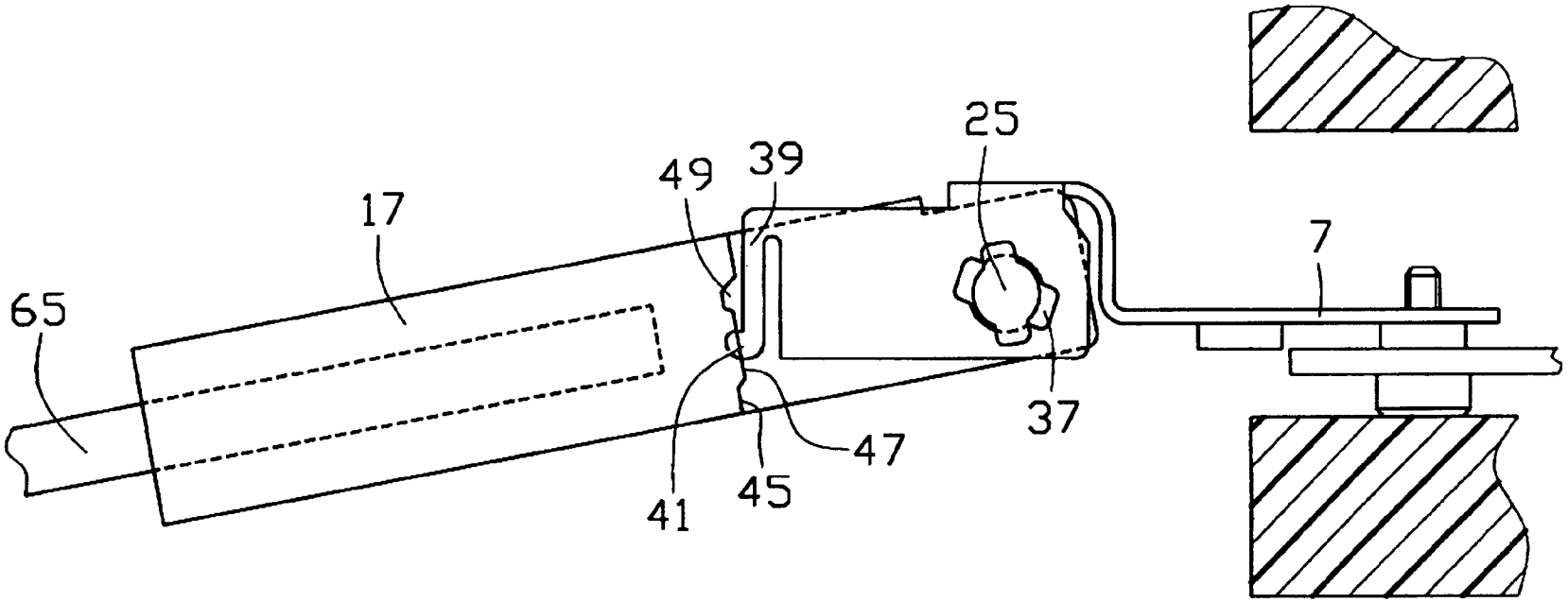
FIG. 8B is a side view of the card connector in a middle position.
Figure 8C:
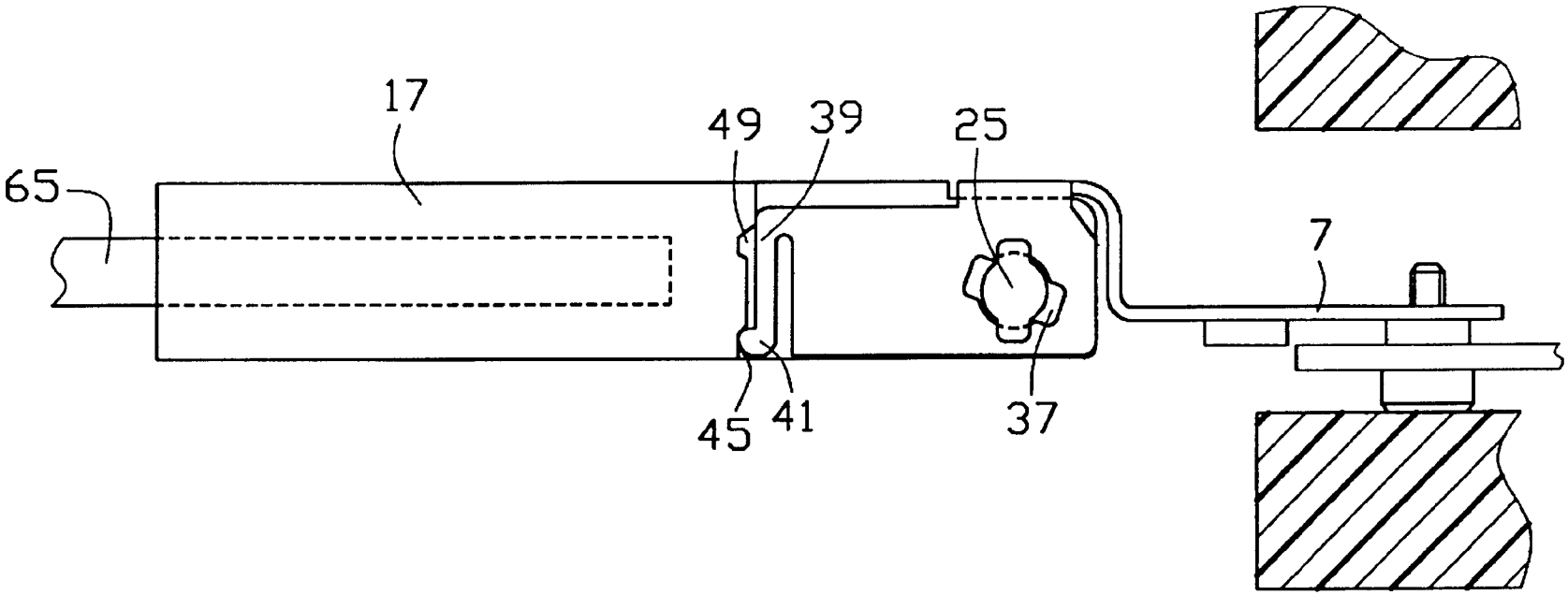
FIG. 8C is a side view of the card connector in a closed position.

FIGS. 8A–8C show the process of sequentially inserting an exterior card 65 into the card connector 1. As shown in FIG. 8A, when the card connector 1 is retained in an open position where the projection 41 of the spring arm 39 is engaged with the second positioning recess 49, the card 65 is loosely inserted into the card connector 1 along the direction of the guiding bar 17. When the card connector 1 is moved to a middle position as is shown in FIG. 8B, the card 65 is further inserted into the card connector 1, and the card connector 1 is further rotated clockwise whereby the projection 41 of the spring arm 39 slides along the sliding face 47 from the second positioning recess 49 to the first positioning recess 45. Finally, as is shown in FIG. 8C, when the card connector 1 has reached a closed position, the protrusion 41 of the spring arm 39 is located in the first positioning recess 45, and the card 65 is completely inserted into the card connector 1 to engage with the terminals 5 of the card connector 1.

Referring back to FIG. 3, when the card 65 (see FIGS. 8A–8C) is completely inserted into the card connector 1, a connection is established between the card 65 and the PCB 57 via the terminals 5 of the card connector 1, the FPC 11 and the board-to board connector assembly 13.

It can be understood that after the header 15 is rotated to its final horizontal position, an abutment plate and a pivot door (both not shown) may be disposed on the top and the bottom thereof for holding the header in position other than the aforementioned positioning devices, i.e., the positioning recess 45, 29 and the protrusion 41.

It is noted that in this embodiment the pivot 25 is integrally formed with the header 15. Understandably, a separate pivot extending through both the end of the header 15 and the clip 7 is an equivalent approach. Similarly, the clip 7 may form the U-shaped clamping section to grasp the end of the header 15 instead of one side abutment. Also, the positioning devices i.e., the positioning recesses 45, 49 and the protrusion 41, may be arranged to be located adjacent to the base plate 29 for reinforcement.

It is appreciated that in this embodiment the header 15 is hinged to the fixing clips 7 so as to be rotatable therewith. Other embodiments may include usage of the curved slots in the engaging section 35 of the clip 7 so that the header 15 may be guidably moved relative to the clip with both rotation and sliding movements for more convenient access.

It is also contemplated that in this embodiment the terminals 5 are electrically connected to the printed circuit board 57 through an FPC 11. Understandably, in another embodiment the FPC can be removed and the tails of the terminals can be variably configured to be resiliently directly seated upon the corresponding circuit pads on the printed circuit board 57 for electrical interconnection between the header 15 when the header is rotated to its horizontal fixed position with regard to the clip 7. This direct abutment type connection without soldering can be referred to the so-called LGA (Land Grid Array) type connectors. Under this situation, because the tails of the terminals 5 are free from any fixed portions, the header can be easily and completely removed from the clip, if necessary, for repairing or other purposes.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card connector adapted to mount to a printed circuit board and to electrically connect an exterior card to the printed circuit board, comprising:

an insulative housing having a header including a plurality of passageways therein and a pair of pivots, and two guiding bars extending from two ends of the header, each guiding bar including a ledge;

a plurality of terminals being received in the corresponding passageways of the insulative housing; and two fixing clips each having a base plate adapted to fix on the printed circuit board, a joint section extending from the base plate adapted to engage with each front end of the guiding bars for preventing over-rotation of the insulative housing, and an engaging section which interferes with the ledge of the insulative housing and pivotably connects with the pivot rotated thereon;

wherein the insulative housing rotates about an axis of the pair of pivots from an open position to a closed position for allowing an exterior card inserted therein to electrically connect with the printed circuit board;

wherein the ledge is defined at a front and outer side of each guiding bar to provide engagement with the fixing clip at different rotational positions;

wherein said pivots project from each end of the header to provide a rotational axis for the fixing clips;

wherein a stopper wall is further formed toward each front end of the upper surface of the guiding bars to prevent the housing from over-rotation;

wherein each engaging section includes an engaging hole for engaging with a corresponding pivot, a spring arm extends from one end of each engaging section and has a protrusion for engaging with the ledge, and a space is formed adjacent the spring arm;

wherein the ledge includes a first positioning recess, a sliding face and a second positioning recess;

wherein each pivot comprises a center post projecting outward from the header and two rectangular projections projecting from the center post, while the engaging hole has a shape similar to that of the pivot;

wherein in assembly, the fixing clips are first fixed on a printed circuit board, the pivots are inserted into the engaging holes, and the housing is rotated about the axis of the pivots;

wherein, when the card connector is positioned at an open position, the protrusions are located in the second positioning recesses; the exterior card can be inserted into the card connector along the direction of the guiding bar, then the housing can be rotated about the axis of the pivots, so that the protrusions slide along the sliding face to the first positioning recess, where the card connector is positioned at the closed position, whereby the exterior card can be completely inserted into the card connector.

* * * * *